US007841875B1

(12) United States Patent
Chen

(10) Patent No.: US 7,841,875 B1
(45) Date of Patent: Nov. 30, 2010

(54) AUDIO JACK CONNECTOR

(75) Inventor: Chung-Yu Chen, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/691,913

(22) Filed: Jan. 22, 2010

(51) Int. Cl.
*H01R 13/453* (2006.01)
*H01R 13/44* (2006.01)

(52) U.S. Cl. ..... 439/138; 439/669

(58) Field of Classification Search ..... 439/138, 439/669, 893
See application file for complete search history.

(56) References Cited

U.S. PATENT DOCUMENTS 3,763,461 A * 10/1973 Kotski ..... 439/185
6,116,959 A * 9/2000 Taylor ..... 439/668
6,558,175 B1 * 5/2003 Yu ..... 439/138
6,572,274 B1 * 6/2003 Margaliot et al. ..... 385/75
6,575,793 B1 * 6/2003 Li et al. ..... 439/668
7,238,059 B1 * 7/2007 Wu ..... 439/668
7,285,024 B1 * 10/2007 Tai ..... 439/668
7,371,125 B2 * 5/2008 McHugh et al. ..... 439/668
7,645,170 B2 * 1/2010 Long et al. ..... 439/668
7,753,738 B2 * 7/2010 Zhang ..... 439/668
2008/0299837 A1 * 12/2008 Long et al. ..... 439/676
2009/0280694 A1 * 11/2009 Zhuang et al. ..... 439/668

* cited by examiner

*Primary Examiner*—James Harvey
(74) *Attorney, Agent, or Firm*—WPAT, P.C.; Anthony King

(57) ABSTRACT

An audio jack connector for receiving a mating audio plug has an insulating housing having a rectangular base. The base defines a front end and a top surface. A passageway is formed at the front end of the base and extends into the base for receiving the audio plug. The top surface of the base has a receiving recess adjacent to the front end. A plurality of terminals is received in the insulating housing and projects into the passageway. A protecting plate is swingably mounted in the receiving recess of the insulating housing. The protecting plate has a base plate, with a shape substantially same as a cross-section of the passageway. The base plate stands across a front end of the passageway for shutting the passageway, and is pushed by the inserted audio plug to swing upwards and received in the receiving recess. A shielding shell covers the insulating housing.

6 Claims, 4 Drawing Sheets

AUDIO JACK CONNECTOR

BACKGROUND OF THE INVENTION

1. Field of the Invention

The present invention relates to a connector, and particularly to an audio jack connector having a protection structure.

2. The Related Art

A conventional audio jack connector is mounted in an electronic device for receiving a mating audio plug. The audio jack connector is generally involved with an insulating housing, a plurality of terminals received in the insulating housing and a shell covered on the insulating housing. The insulating housing has a passageway for receiving the audio plug, and a plurality of recesses for receiving the terminals. Each of the recesses communicates with the passageway and has an opening formed at a bottom of the insulating housing for allowing a soldering portion of each terminal to pass therethrough for being soldered to a printed circuit board (PCB) underlain the insulating housing. However, when the audio plug is not inserted into the passageway of the audio jack connector, it is possible that some exterior objects such as dust, water and the like, may enter into the audio jack connector through the passageway and affect the electrical connection between the terminals and the PCB.

SUMMARY OF THE INVENTION

Accordingly, an object of the present invention is to provide an audio jack connector with a protection structure. The audio jack connector for receiving a mating audio plug has an insulating housing having a rectangular base. The base defines a front end and a top surface. A passageway is formed at the front end of the base and extends into the base for receiving the audio plug. The top surface of the base has a receiving recess adjacent to the front end. A plurality of terminals is received in the insulating housing and projects into the passageway. A protecting plate is swingably mounted in the receiving recess of the insulating housing. The protecting plate has a base plate, with a shape substantially the same as a cross-section of the passageway. The base plate stands across a front end of the passageway for shutting the passageway, and is pushed by the inserted audio plug to swing upwards and received in the receiving recess. A shielding shell covers the insulating housing.

As described above, the audio jack connector has the protecting plate which is swingably mounted in the insulating housing. When the audio plug is not inserted into the audio jack connector, the protecting plate shuts the passageway to prevent the foreign objects from entering the passageway. Therefore, the protecting plate guarantees the normal use of the audio jack connector. When the audio plug is inserted into the audio jack connector, the protecting plate is pushed to swing upwardly and received in the receiving recess, without affecting the electrical connection between the audio jack connector and the audio plug.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
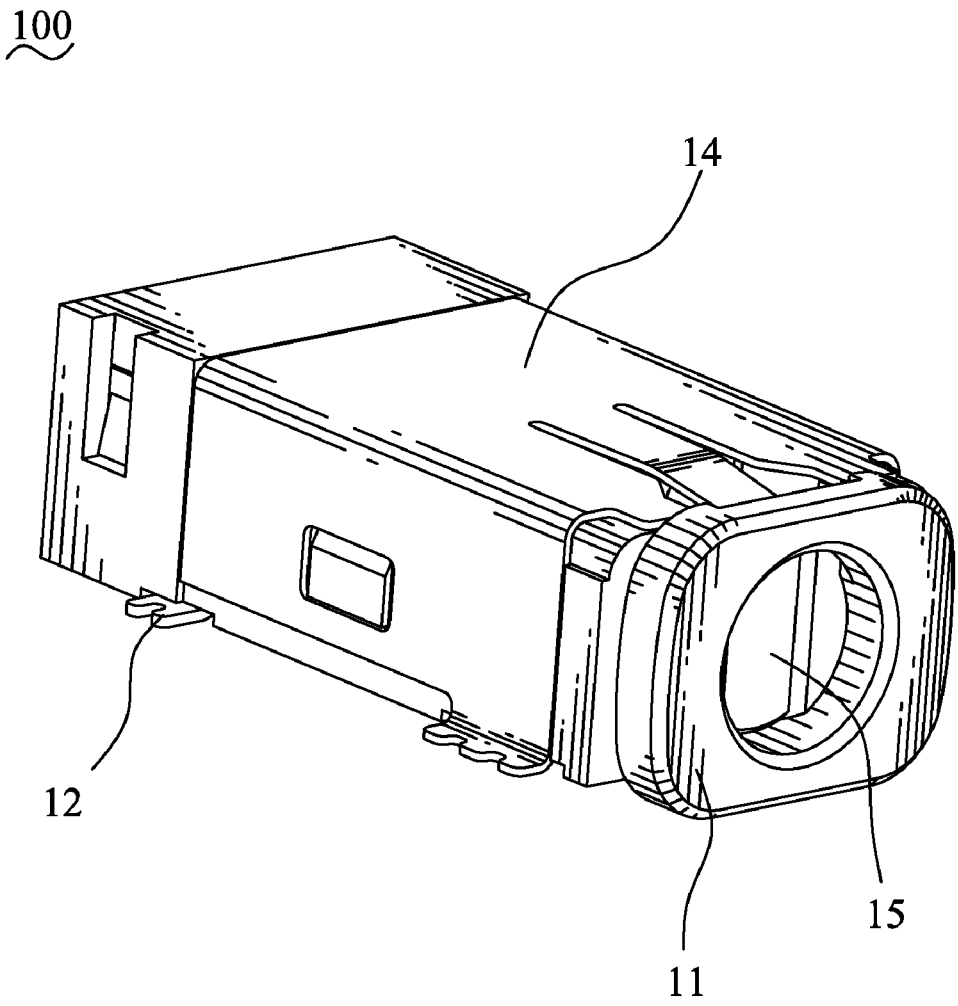
FIG. 1 is a perspective view of an audio jack connector of an embodiment in accordance with the present invention.

Reference will now be made to the drawing figures to describe the present invention in detail.

Figure 2:
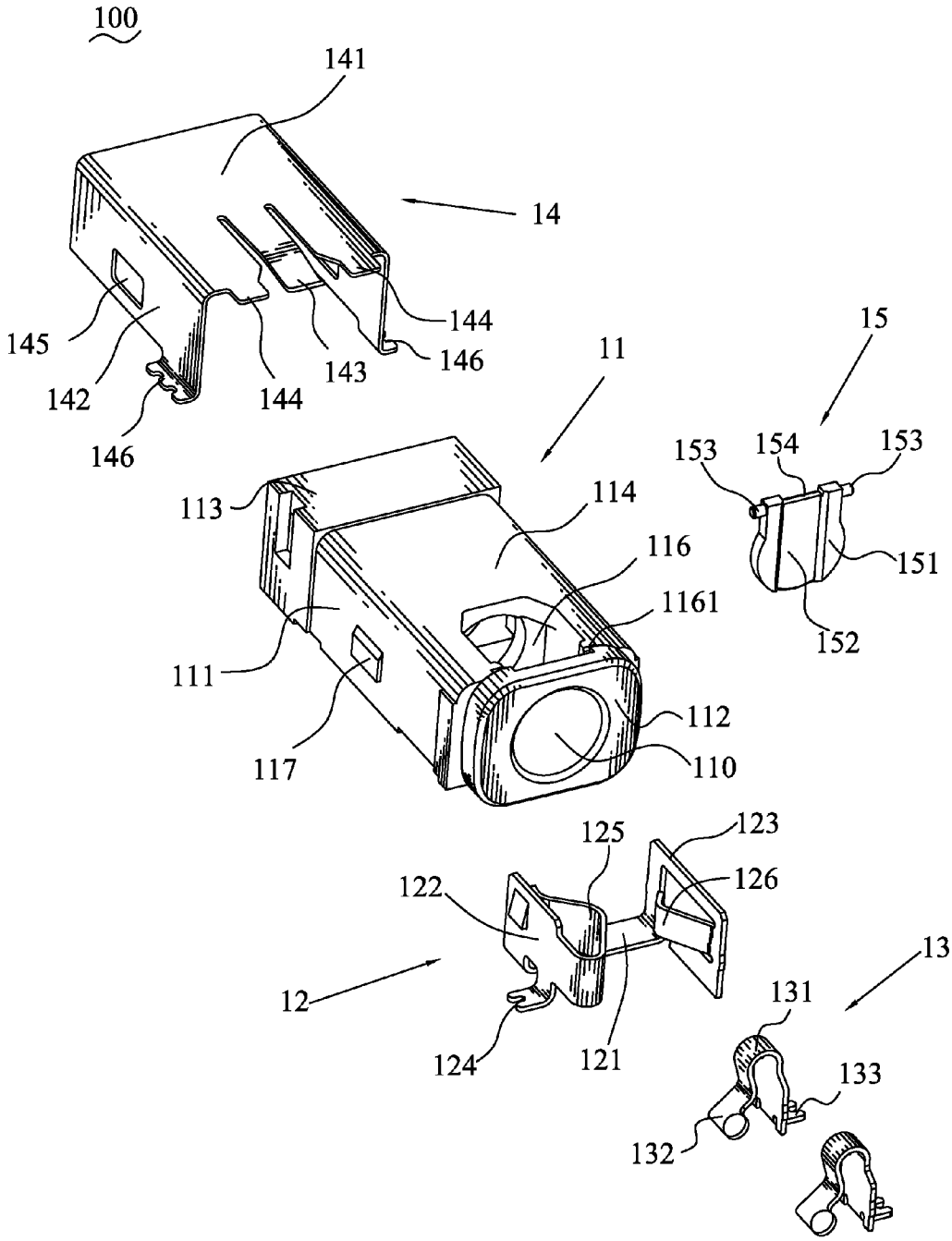
FIG. 2 is an exploded, perspective view of the audio jack connector shown in FIG. 1.

Please refer to FIGS. 1-2, an audio jack connector 100 for receiving a mating audio plug 200 (shown in FIG. 6) comprises an insulating housing 11, a plurality of terminals received in the insulating housing 11, a shielding shell 14 covering the insulating housing 11 and a protecting plate 15 mounted in the insulating housing 11.

Figure 3:
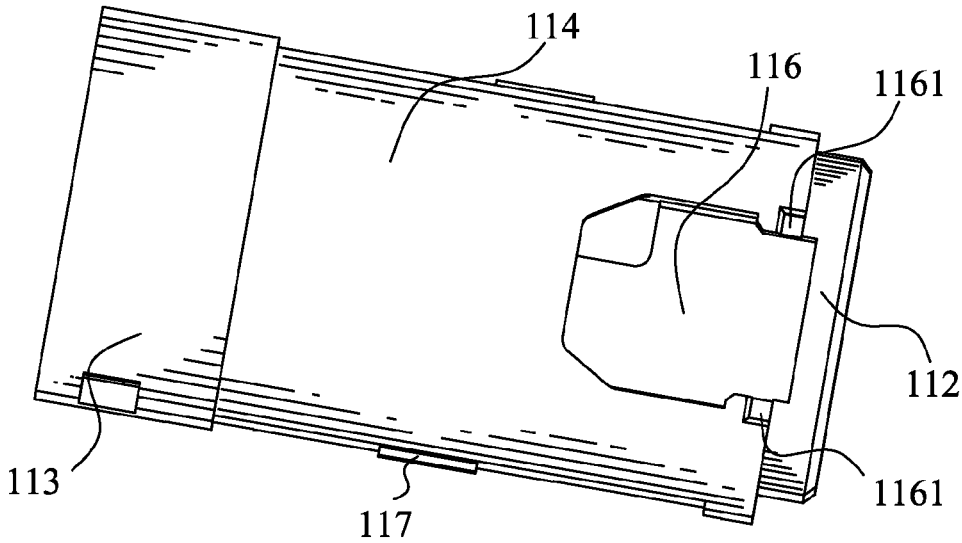
FIG. 3 is a perspective view of an insulating housing of the audio jack connector shown in FIG. 2 viewed from a top angle.
Figure 4:
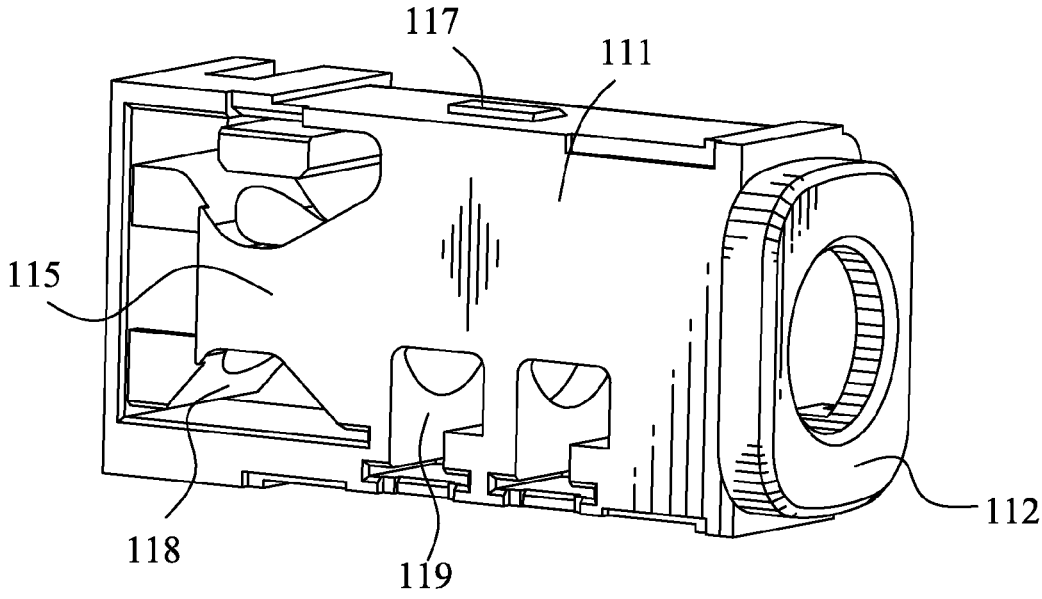
FIG. 4 is a perspective view of the insulating housing of the audio jack connector shown in FIG. 2 viewed from a bottom angle.

Referring to FIGS. 2-4, the insulating housing 11 has a substantially rectangular base 111. The base 111 defines a front end 112, a rear end 113 opposite to the front end 112, a top surface 114 and a bottom surface 115 both connecting with the front end 112 and the rear end 113. A passageway 110, with a circular cross-section, is formed in the base 111 and passes through a middle portion of the front end 112 for receiving the audio plug 200. In this embodiment, the front end 112 is formed as a rectangular platform shape, having four smooth corners, and the rear end 113 has an outer peripheral dimension larger than that of the other portion of the base 111.

The top surface 114 has a receiving recess 116 adjacent to the front end 112. The receiving recess 116 is substantially rectangular and communicates with the passageway 110. Two opposite sides of the receiving recess 116 have front ends formed with two facing installing notches 1161. The installing notches 1161 reach the top surface 114. The bottom surface 115 has a first groove 118 at a rear end thereof, and two abreast second grooves 119 at a side thereof and forward of the first groove 118. The first groove 118 and the second grooves 119 communicate with the passageway 110. The base 111 further has two lumps 117 at two opposite sides thereof.

Please refer to FIG. 2, the protecting plate 15 is substantially rectangular and has a base plate 151, with a shape thereof substantially same as the cross-section of the passageway 110. The base plate 151 has a front surface formed with a groove 152 at a middle portion thereof. The groove 152 extends upwards and downwards, and passes through the whole front surface of the base plate 151 for guiding a free end of the audio plug 200 to slide therein. A middle portion of a top edge of the base plate 151 is formed with a locking recess 154 communicating with the groove 152. Two opposite sides of the base plate 151 have upper portions protruded outwardly/laterally to form two installing posts 153, corresponding to the installing notches 1161. In assembly, the base plate 151 stands across a front end of the passageway 110 through the receiving recess 116. The installing posts 153 are respectively and rotatably mounted in the installing notches 1161.

The terminals include a first terminal 12 and two second terminals 13. The first terminal 12 has a connecting plate 121. The connecting plate 121 is a strip shape and has two opposite ends bent upwards and frontward to form a first fixing plate 122 and a second fixing plate 123 facing the first fixing plate 122. The first fixing plate 122 has a front end, away from the connecting plate 121, bent toward the second fixing plate 123 to form a first contact portion 125 folded up with respect to the first fixing plate 122. A bottom edge of the first fixing plate 122 has a portion bent back to the second fixing plate 123 to form a soldering peg 124. The second fixing plate 123 is punched toward the first fixing plate 122 to form a second contact portion 126. The first contact portion 125 and the second contact portion 126 are arched toward each other and spaced away from each other with a predetermined distance. In assembly, the first fixing plate 122 and the second fixing plate 123 are mounted in the first groove 118. The first contact portion 125 and the second contact portion 126 are projected into the passageway 110 for electrically and resiliently connecting with the inserted audio plug 200. The soldering peg 124 is exposed outside the insulating housing 11 for being soldered to a PCB (not shown).

The second terminal 13 has a holding portion 131 of substantially inverted-U shape. One free end of the holding portion 131 is extended downwardly and deflected outwards to form a third contact portion 132. The other free end of the holding portion 131 is extended opposite to the third contact portion 132 to form a soldering portion 133. In assembly, the holding portions 131 are located in the second grooves 119. The third contact portions 132 project into the passageway 110 for electrically connecting with the inserted audio plug 200. The soldering portions 133 are exposed outside the insulating housing 11 for being soldered to the PCB.

Figure 5:
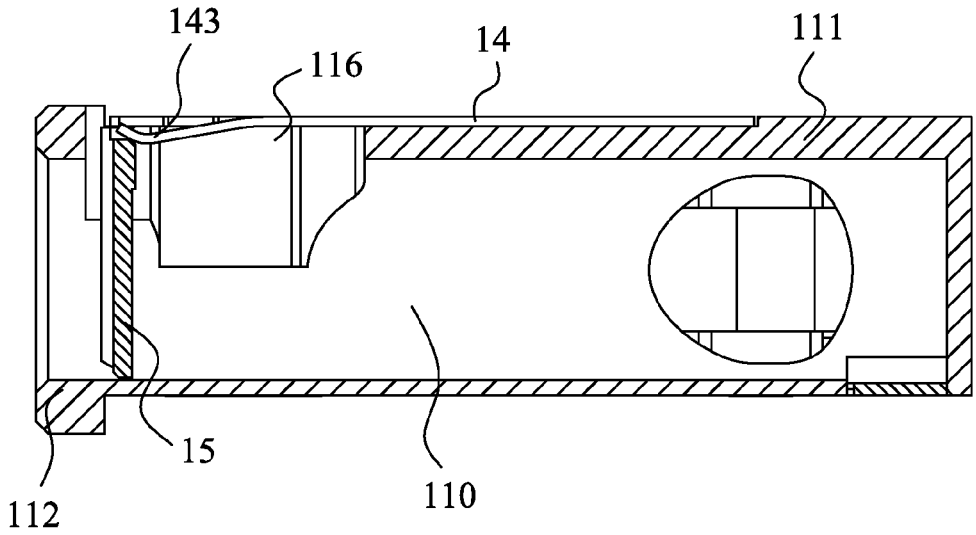
FIG. 5 is a cross-sectional view of the audio jack connector shown in FIG. 1.

With reference to FIG. 2 and FIG. 5, the shielding shell 14 is substantially door-shaped, and has a covering plate 141 and two lateral plates 142 extended downwards from two opposite sides of the covering plate 141. The covering plate 141 is attached to the top surface 114 of the base 111. The covering plate 141 has a front edge 144 extended frontward and contiguous to the lateral plates 142, and a cantilever locking arm 143 at a front end thereof. The locking arm 143 extends frontward and has a free end arched downwards. Each of the lateral plates 142 is formed with a buckling opening 145, corresponding to the lump 117. A bottom edge of the lateral plate 142 has a front end bent outwards to form a grounding peg 146. In assembly, the shielding shell 14 is coupled with the base 111 and restrained between the front end 112 and the rear end 113. The front edge 144 presses onto the top edge of the base plate 151 for preventing the protecting plate 15 from moving upwards. The locking arm 143 rests against a bottom of the locking recess 154 of the protecting plate 15.

Figure 6:
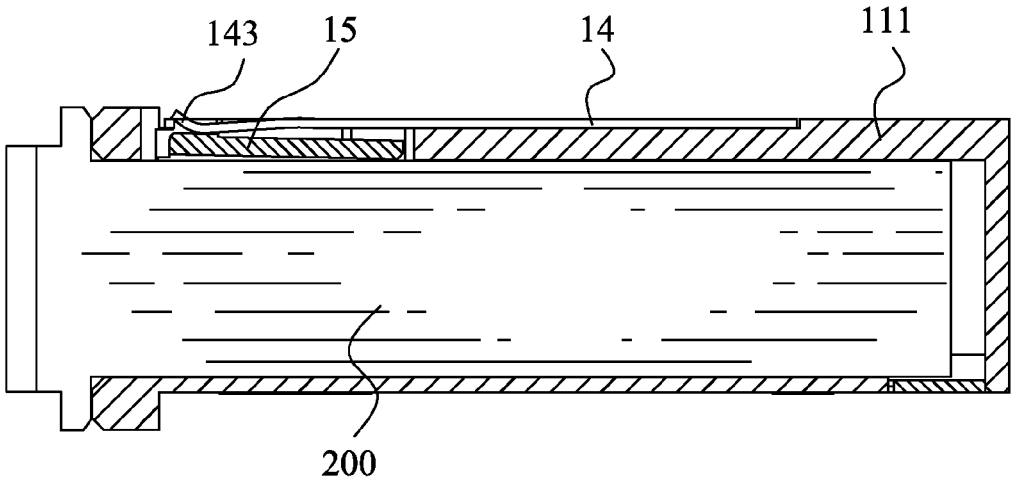
FIG. 6 is a cross-sectional view of the audio jack connector shown in FIG. 1, wherein a mating audio plug is inserted therein.

Please refer to FIG. 5 and FIG. 6, when the audio plug 200 is not inserted into the passageway 110 of the audio jack connector 100, the protecting plate 15 stands across the front end of the passageway 110 for shutting the passageway 110, thereby preventing the foreign objects from entering the passageway 110. The locking arm 143 buckles with the locking recess 154 to ensure that the protecting plate 15 shuts the passageway 110 all the time. When the audio plug 200 is inserted into the passageway 110 of the audio jack connector 100, the free end of the audio plug 200 rests against a bottom of the groove 152, pushes the base plate 151 to swing upwardly until received in the receiving recess 116. The locking arm 143 presses on a rear surface of the protecting plate 15 opposite to the groove 152 for fixing the protecting plate 15 to the insulating housing 11 firmly.

As described above, the audio jack connector 100 has the protecting plate 15 which is swingably mounted in the insulating housing 11. When the audio plug 200 is not inserted into the audio jack connector 100, the protecting plate 15 shuts the passageway 110 to prevent the foreign objects from entering the passageway 110. Therefore, the protecting plate 15 guarantees the normal use of the audio jack connector 100. When the audio plug 200 is inserted into the audio jack connector 100, the protecting plate 15 is pushed to swing upwardly and received in the receiving recess 116, without affecting the electrical connection between the audio jack connector 100 and the audio plug 200.

What is claimed is:

1. An audio jack connector for receiving a mating audio plug, comprising:

an insulating housing having a rectangular base, the base defining a front end and a top surface, a passageway formed at the front end of the base and extending into the base for receiving the audio plug, the top surface of the base having a receiving recess adjacent to the front end;

a plurality of terminals received in the insulating housing and projecting into the passageway;

a protecting plate swingably mounted in the receiving recess of the insulating housing, the protecting plate having a base plate, with a shape substantially the same as a cross-section of the passageway, the base plate standing across a front end of the passageway for shutting the passageway, and being pushed by the inserted audio plug to swing upwards and received in the receiving recess; and a shielding shell covered to the insulating housing.

2. The audio jack connector as claimed in claim 1, wherein the top surface has two installing notches at front ends of two opposite sides of the receiving recess and facing each other, two opposite sides of the base plate have upper portions protruded laterally to form two installing posts received in the corresponding installing notches.

3. The audio jack connector as claimed in claim 2, wherein the shielding shell has a covering plate pressing onto a top edge of the base plate for preventing the base plate from moving upwards.

4. The audio jack connector as claimed in claim 3, wherein a front end of the covering plate is formed with a separated locking arm buckled with a locking recess formed at a middle portion of the top edge of the base plate.

5. The audio jack connector as claimed in claim 4, wherein the locking arm has a free end arched downwards, for resting against a bottom of the locking recess.

6. The audio jack connector as claimed in claim 4, wherein a front surface of the base plate has a groove extending upwards and downwards and communicating with the locking recess, for guiding a free end of the audio plug to slide therein.

* * * * *